United States Patent [19]

Picciochi

[11] 4,226,160

[45] Oct. 7, 1980

[54] UNITARY PICK HAVING MULTIPLE PICKING SURFACES

[76] Inventor: Andrew V. Picciochi, 208 Andrews Rd., Mineola, N.Y. 11501

[21] Appl. No.: 959,927

[22] Filed: Nov. 13, 1978

[51] Int. Cl.[3] ..... G10D 3/16

[52] U.S. Cl. ..... 84/322

[58] Field of Search ..... 84/322, 320–321

[56] References Cited

U.S. PATENT DOCUMENTS

| | | | |
|---|---|---|---|
| 634,142 | 10/1899 | Heymann | 84/322 |
| 768,241 | 8/1904 | Seidel | 84/322 |
| 2,221,234 | 11/1940 | Frasier | 84/322 |
| 2,449,890 | 9/1948 | Garlick | 84/322 |
| 2,481,759 | 9/1949 | Lawrence | 84/322 |
| 3,312,137 | 4/1967 | Oddo | 84/322 |
| 4,020,732 | 5/1977 | Kelly | 84/322 |

*Primary Examiner*—Lawrence R. Franklin

*Attorney, Agent, or Firm*—Bauer & Amer

[57] ABSTRACT

A pick having a pair of relatively spaced pick blades integrally connected and unitarily formed of a flexible and resilient material such that the normally spaced-apart relation of the string-engaging blades is selectively variable for changing the interval between sequential contacts of the blades with the strings of a musical instrument.

12 Claims, 9 Drawing Figures

UNITARY PICK HAVING MULTIPLE PICKING SURFACES

The present invention relates to picks for use in playing stringed musical instruments.

It is an object of the present invention to provide a unitary pick of particularly simple construction having multiple picking surfaces and edges.

It is also an object of the present invention to provide a pick that, when moved engagingly across at least a string of a musical instrument, produces sound having enhanced tonal qualities and characteristics.

It is another object of the invention to provide a pick that may be utilized to selectively produce either single or multiple sequential tones from each string of a musical instrument as a result of contact of the pick therewith.

It is a further object of the present invention to provide a pick for producing multiple sequential sounds upon contact with a string and with which the time interval between the multiple sequential sounds produced may be selectively varied during use of the pick.

It is still another object of the invention to provide a pick that produces a sound having particularly bright tonal characteristics when the pick strikes a string and that includes as an integral part of the sound produced a distinctive click resulting from contact of the pick with the string.

It is yet a further object of the present invention to provide a pick wherein the tonal characteristics of the sound produced by movement of the pick across a musical instrument string may be selectively modified so as to predeterminately dampen the tone of the sound produced.

Further objects, features and advantages of the present invention will be more fully appreciated by reference to the following detailed description of presently preferred, but nonetheless illustrative, embodiments in accordance with the present invention when taken in conjunction with the accompanying drawings, wherein.

DESCRIPTION OF THE PREFERRED EMBODIMENTS

The present invention is directed toward a novel structure for a pick or plectrum which includes multiple picking surfaces and which produces distinctively enhanced sound tonal characteristics upon contact with a string or group of strings of a musical instrument. Use of selected portions of the pick to movingly contact the instrument's strings results in the production of controllably different pick-string vibratory interaction. Although particularly well suited to multi-string strumming or chording, it will be readily apparent that the inventive pick may also be used for separately engaging individual ones of an instrument's strings with equally unusual and distinctive results.

Figure 1:
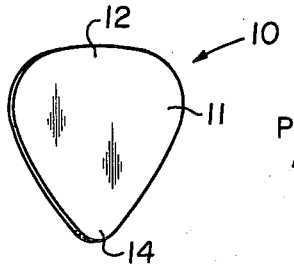
FIG. 1 PRIOR ART
FIG. 1 is a front view of a conventional prior art pick.

A more complete understanding and appreciation of the contribution of the present invention will be best realized by a brief consideration of the prior art. As seen in FIG. 1 of the drawing and identified by the general reference numeral 10, conventional prior art picks for guitars and like stringed musical instruments are characterized by a substantially flat, planar pick blade 11 of triangular configuration having a widened gripping portion 12 and tapering to a narrow, rounded or arcuate string-engaging portion 14. The material of construction of the prior art pick 10 is generally a thick, substantially rigid plastic or the like which provides little flexibility and which tends to break or chip, particularly in the area of the playing tip 14, with continued use. The thickness and relative inflexibility of the conventional pick 10 is intentionally provided so as to enable the user to pick or contact individual or groups of strings on the guitar or other musical instrument with appreciable force. This structure is for the most part a carry-over from the period before the introduction of magnetic pick-ups and electronics which now enable selectively controlled electrical amplification of the sound produced by a stringed instrument irrespective of the amount of force with which the same is played.

Also known in the prior art are picks having multiple picking edges. Typically, these multi-pick structures, such as that disclosed in U.S. Pat. No. 3,312,137 to Oddo, are formed merely by interposing spacing members connectingly intermediate two or more of the prior art picks 10. The stiffness and relative inflexibility of the individual picks 10 becomes particularly disadvantageous when the same are incorporated in a combination or multi-pick structure due, inter alia, to the difficulty of holding the string-engaging edges of the several pick blades of the multi-pick structure in proper position or alignment for sequential contact of the multiple edges with one or a series of strings to be engaged thereby.

Figure 2:
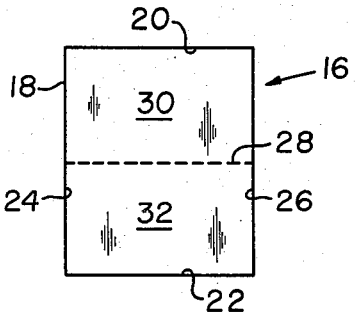
FIG. 2 is a developmental view of a pick constructed in accordance with the present invention.
Figure 3:
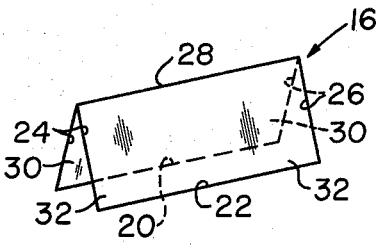
FIG. 3 is a perspective view of the completed inventive pick of FIG. 2.
Figure 4:
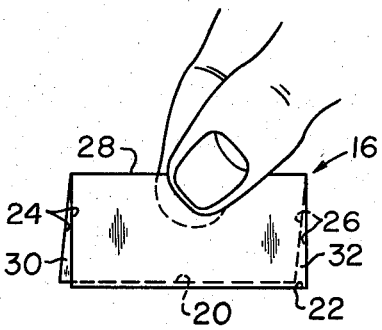
FIG. 4 is a perspective view of the inventive pick of FIGS. 2 and 3 gripped between the fingers of a user.

A preferred embodiment of a pick constructed in accordance with the present invention is designated by the general reference numeral 16 in FIGS. 2 through 4. The pick 16 is formed of an initially planar, substantially rectangular member 18 having parallel opposed string-engaging or contact edges 20, 22 at its longitudinally disposed ends and sides 24, 26 connecting the same. As this description proceeds, it will become evident that the relationship of the sides 24, 26 to each other and with the opposed edges 20, 22 is not critical. That is, the sides 24, 26 need not be disposed parallel to each other nor must they necessarily be perpendicular to the edges 20, 22. As a consequence, although the member 18 shown in FIGS. 2 through 4 and described herein is substantially rectangular in configuration, it should be understood that such shape is not necessary to the concept of the present invention and it is preferred only that the member 18 is quadrilaterally configured. In addition, the substantially parallel disposition of the string-engaging edges 20, 22 in the embodiment of FIGS. 2 through 4 is likewise preferred but not required.

The member 18 preferably comprises a relatively thin material having the properties of substantial flexibility and resilience. By way of example only, the material of construction of the member 18 may be an estar-base plastic of substantially uniform thickness, this material having been found to provide notable sound-enhancing results, although any sheet-like material having comparable or equivalent physical structural characteristics may be utilized in accordance with the teachings of the invention. The precise thickness of the material of the member 18 is likewise not critical and it has, in fact, been found that utilizing materials of different thickness in forming the member 18 results in interesting and definite variations in the tonal qualities and characteristics of the sound produced by way of the interaction of the completed pick 16 with an instrument string.

The member 18 is folded about and along the imaginary dotted line designated 28 in FIG. 2 which is seen to run transverse to the elongation of the member 18 and substantially equidistant between and parallel to the opposed string-engaging edges 20 and 22. Folding of the member 18 along the line 28 forms a crease in the material thereof for maintaining the fold and results in the completed pick configuration shown in FIG. 3.

As seen in FIG. 3, the completed pick 16 resembles an inverted three-dimensionally-elongated V having a fold line or edge 28 and face panels or pick blades 30 and 32 unitarily connected at and depending therefrom. The pick blades 30, 32 relatively angularly diverge outwardly from the fold 28 and terminate at the respective string-engaging edges 20, 22. Thus, maintenance of the fold 28 in the member 18 and the relative angular divergence of the pick blades 30, 32 results in the disposition of the string-engaging edges 20, 22 in normally spaced-apart relation in the manner best shown in FIG. 3. It will be appreciated that the pick 16 is symmetrically configured on either side of the fold 28 and as a consequence the spaced apart edges 20, 22 are disposed substantially parallel to one another. Put another way, each of the pick blades 30, 32 outwardly extends an equal distance from the common fold 28 integrally and unitarily connecting the same to a respective one of the string-engaging edges 20, 22 arranged parallel to the fold or crease 28.

The angle formed between the pick blades 30, 32 by virtue of their outward extension from the connecting fold 28 may be varied due to the inherent flexibility of the member 18. Thus, a decrease in this angle by reason of the application of an oppositely or inwardly directed force on the outwardly disposed face of each of the pick blades 30, 32 will effect a closure or decrease in the angular separation between the normally spaced apart string-engaging edges 20, 22 in opposition to the normal outward urging created by the fold which tends to cause the blades to return to their normally maintaind angular separation. Accordingly, the resilience of the material of construction of the member 18 insures that when the oppositely directed forces applied to the pick blades 30, 32 are decreased or removed, the angle therebetween will automatically increase to return the edges 20, 22 to their normally spaced apart relation.

As a consequence, in use the pick 16 may conveniently be held between a user's fingers in the manner shown in FIG. 4 wherein the pick is gripped by the fingers in the area of the fold 28. In this manner, a selectively adjusted force may be relatively oppositely applied to the outwardly disposed faces of the blades 30, 32 in the area of the fold 28 to enable the user to position the string-engaging edges 20, 22 in selectively spaced-apart separation.

It will be appreciated that depending upon the magnitude of the pressure or force opposingly applied between the user's fingers to the pick blades 30, 32, the distance or separation between the sring-engaging edges 20, 22 is selectively and desirably variable between the maximum separation normally resiliently maintained as seen in FIG. 3 and the more narrowed separation illustrated in FIG. 4 wherein the pick blades 30, 32 are placed almost contiguous with one another on their inwardly disposed faces. In a manner readily understood, the application of a maximum of oppositely-directed finger pressure to the blades 30, 32 will result in the further movement of the blades 30, 32 beyond the position of FIG. 3 so that the same lie fully contiguous and touching one another on their inwardly disposed faces and thereby effectively form or resemble almost a single sheet of material. In this position, the string-engaging edges 20 and 22 meet and overlap in aligned, contiguous relation so as to likewise appear to constitute a single edge.

When the inventive pick 16 is moved across one or a series of strings on a musical instrument, the tonal quality of the sound produced by vibratory interaction of the pick and the string is unusually bright in comparison with the sound produced by use of a prior art or conventional pick 10. As understood, this brightness is at least in part due to the advantageously thin and flexible construction of the member 18 comprising the inventive pick which permits significant flexure of the pick blades 30, 32 as the same are moved or swept engagingly across the strings. The brightness of the sound is further enhanced by the presence of an audible "click" in the nature of a slap as an integral feature of the sound and which is produced as each string-engaging edge 20, 22 of the pick 16 is flexibly deflected as it strikes or slaps a string and thence rebounds or returns to its normal disposition after contact therewith. These clicks or slaps constitute an unmistakable and distinctive part or characteristic of the sound produced by interaction of the pick 16 with each string and provide novel and enhanced effects on the tone and quality of the resulting sound.

As the pick 16 is moved across a string, a click is produced as each of the edges 20, 22 briefly engage the string. Thus, it may be readily appreciated that a pair of clicks actually results as the two string-engaging edges 20, 22 sequentially contact the string. Since the clicks are produced as the pick blades flex and thence rebound as a consequence of engagement with the string, the interval between the sequential pair of clicks is dependent upon the selectively maintained separation of the string-engaging edges 20, 22 of the pick. Accordingly, by increasing the amount of force with which the pick blades 30, 32 are pressed together, and thereby decreasing the distance or separation maintained between the edges 20, 22, the time interval between the resultant sequential pair of clicks will be decreased. It should be noted, however, that even with the pick blades 30, 32 pressed fully and firmly together so as to position the edges 20, 22 flat against or contiguous with one another, a clearly defined double click will be produced on contact of the edges with the string due to the significant flexibility of the material of the pick 16 which enables a brief separation of the contiguous edges 20, 22 as they sweep across the string.

It is anticipated that the inventive pick 16 will normally be grasped along the fold 28 so as to position the edges 20, 22 for engaging contact with the strings of a musical instrument. Use of the edges 20, 22 for strumming movement across a series of adjacently positioned strings will result in the production of distinctive and novel-sounding musical chords. However, it should be clear to those skilled in the art that any of the edge portions of the pick 16 may alternatively be positioned or held for string-engaging contact to produce sounds having differing tonal qualities. Thus, engagement of the strings may be made with and along the sides 24, 26 of the pick 16. Or, the strings may be strummed or played with the folded edge 28 which, because it essentially comprises a double width of the material of construction, is considerably less flexible than either of the individual edges 20 or 22 and consequently results in the production of sound not quite as bright as that produced by contact of the strings with the edges 20, 22. For the selective picking of individual strings, the corners defined between the sides 24, 26 and edges 20, 22, or those defined between the folded edge 28 and the sides 24, 26, may be used for string-engaging contact so as to permit crisper delineation of each musical tone produced by oscillation or vibration of the strings.

Figure 5:
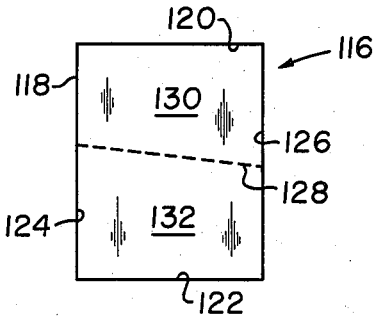
FIG. 5 is a developmental view of another embodiment of a pick according to the present invention.
Figure 6:
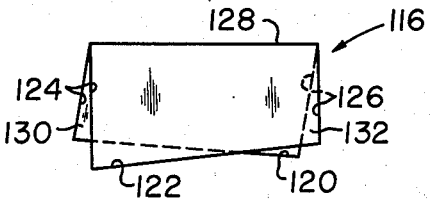
FIG. 6 is a side elevational view of the pick of FIG. 5.

There is shown in FIGS. 5 and 6 a second embodiment of a pick constructed in accordance with the present invention which is designated by the general reference numeral 116. In most respects, the details of construction of the modified pick 116 may be in accordance with those set forth above in relation to the pick 16. Hence, a repetition of such details would be redundant and superfluous and is omitted. However, for convenience and understanding, and to emphasize the basic structural similarities between the described embodiments of the invention, similar reference characters having the additional prefix 100 have been utilized in FIGS. 5 and 6 to indicate or denote elements similar to identical to those discussed with regard to FIGS. 2 through 4.

As best seen in the developmental view of FIG. 5, the substantially rectangular member 118 of the modified pick 116 is creased or folded along a line 128 intermediate the string-engaging edges 120, 122. Unlike the earlier-discussed embodiment of FIGS. 2 through 4, however, the fold line 128 is disposed or located non-parallel to the edges 120, 122. As a consequence, in the constructural arrangement of the completed pick 116 seen in FIG. 6, the pick blades 130, 132 are relatively asymmetric and the string-engaging edges 120, 122 are positioned out of alignment with each other. Put another way, in their normally spaced-apart relation, each of the edges 120, 122 is disposed non-planar relative to the other; when the pick blades 130, 132 are pressed flatly together by applying an oppositely-directed pressure to the outer faces of each, the edges 120, 122 are positioned in non-parallel relation.

It can, therefore, be appreciated that when the modified pick 116 is moved across the strings of a musical instrument, the time interval between the sequential engagement of the edges 120, 122 with each of the strings will vary depending upon the point along the edges 120, 122 at which contact with the strings is effected. As a result, the sequential clicks that form an integral portion of the sound or tones produced as the pick is swept or moved across a plurality of adjacent strings will vary as to timing between each click and between each sequential pair of clicks depending upon the rate at which the pick is moved across the strings and the edge portion(s) with which string contact is made. This effect which may resemble or be in the nature of a counter or secondary tempo relative to the rhythm of the music notably enhances the characteristics and qualities of the musical tones produced by vibration of the strings in a most interesting and desirable manner.

It may at times be desirable in using the inventive pick for its intended purpose of playing a stringed musical instrument to dampen or dull the brightness of the sound produced when the pick effects vibration of the strings and/or to decrease the audible distinctiveness of the clicks resulting from contact of the pick blades with the strings. In practice, it has been found that both of these ends can be accomplished to selectively varying degrees by way of the application of a member stiffening means in overlaid relation on predetermined surface and/or edge portions of the pick.

Figure 7:
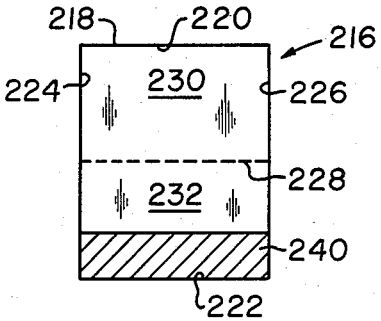
FIGS. 7, 8 and 9 are developmental views of yet another embodiment of a pick according to the present invention which includes tone modifying means on selected surfaces and edges of the pick.

A pick 126 having a constructural configuration like that of the first described embodiment of FIGS. 2 through 4 but incorporating a predeterminately-applied rigidifying or stiffening means is seen in the developmental view of FIG. 7. Again, like reference numerals incorporating the prefix 200 have been utilized to denote similar elements among the several embodiments. In FIG. 7, a stiffening means designated 240 has been applied to a portion of the pick blade 232 adjacent to and including the string-engaging edge 222 thereof.

Preferably, the stiffening means 240 may comprise an adhesive-backed tape such as masking or cellophane tape which provides the advantage and convenience of easy application and removal. It should, however, be understood that any material which has the desired effect of predeterminately decreasing the flexibility of the member 218 in the area of its application thereto would be acceptable. In fact, it has been found that different materials, such by way of example as various kinds of adhesive-backed tape, dampen the brightness of the resulting sound and of the clicks produced by differing amounts when applied to the same portion of the pick 216. Thus, although for purposes of discussion the stiffening means 240 will be assumed to comprise a selected length and width of tape overlaid on predetermined portions of the pick 216, the described use of tape is not deemed to constitute a limitation on the scope or teaching of the invention.

In positioning the stiffening means or tape 240 on the pick blade 232 as in FIG. 7, the edge of the tape may terminate contiguous with the string-engaging edge 222, or it may be folded so as to continue over the edge 222 and terminate on the reverse or opposite face of the pick blade 232. Of course, the tonal qualities and characteristics of the sound produced by interaction of the pick with the strings will vary depending upon whether or not the tape 240 fully encircles the string-engaging edge 222. In particular, substantial dampening or suppression of the click produced by interaction of the pick and string will be effected when the tape 240 encircles and thereby rigidifies or stiffens the string-engaging edge 222 so that the tape 240, and not the edge 222, actually contacts the string. it will, however, be appreciated that placement of the tape 240 on only one of the string-engaging edges 220 or 222 will still permit the click to be heard as the other edge engages the string. Thus, in order to more completely suppress or damp the clicks which form an inherent and integral portion of the sound produced by interaction of the pick 216 with the strings of a musical instrument, the tape 240 would be applied to each of the blades 230, 232 in the manner shown for the single blade 232 in FIG. 7 so that the tape fully surrounds each of the string-engaging edges 220, 222. The application of a second strip of tape to the corresponding edge portion of the other pick blade will have the additional effect of further dulling or deepening the musical tone or sound produced.

Figure 8:
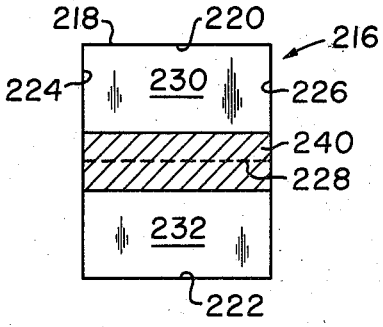

FIG. 8 suggests another surface portion of the pick 216 to which the tape or stiffening means 240 might alternatively be applied. In particular, the tape 240 is shown overlaying and encompassing the crease or fold 228. Although this placement of the tape 240 will have its most significant effect when the pick 216 is inverted for contact or engagement of the strings with and along the fold 228, it should be understood that a tone dampening effect will also be evident in using the pick arrangement of FIG. 8 when engagement of the strings is made with the usual string-engaging edges 220, 222.

Figure 9:
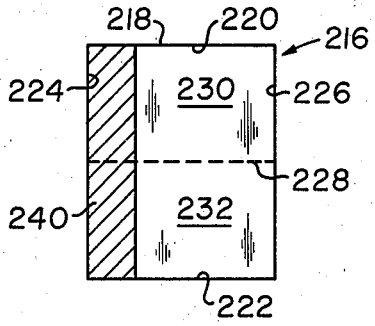

There is illustrated in FIG. 9 yet another suggested alternative positioning of the tape or stiffening means 240 on the pick 216. In this variation, the tape 240 is overlaid along the side 224 of the member 218. As before, the edge of the tape may terminate contiguous with the side 224 or continue surroundingly thereover to terminate on the reverse face of the pick member 218. The pick 216 of FIG. 9 may advantageously be used to substantially suppress the clicks resulting from contact of the pick with the strings by utilizing for engagement with the strings the corners of the pick covered by the tape 240 which are normally adjacently positioned when the member 218 is folded to form the completed pick 216. On the other hand, the uncovered opposite corners of the pick may be utilized for contact with the strings when it is desired to render audible the clicks or slaps of the edges against the strings. Thus, the pick 216 of FIG. 9 permits the user to quickly and easily alternate between providing and suppressing the clicks in the course of use.

Those skilled in the art will readily appreciate that the varied positioning of the stiffening means 240 in FIGS. 7, 8 and 9 are merely illustrative and suggestive of the manner in which a stiffening means may be applied to the inventive pick 216. Each different arrangement of the tape 240 on the pick member 218 will result in differently enhanced tonal qualities of the resulting sound. In addition, for any given placement of the stiffening means on the pick 216, string-engaging contact of different edges of the pick will result in correspondingly different tone-modifying effects of the sound produced. Thus, the combination of a stiffening means 240 and the inventive pick 216 provides the ability to create a virtually endless variety of differing tonal qualities upon contact of the pick with the strings of a musical instrument depending upon the placement of the stiffening means on the pick member 218 as well as the particular edge portion of the pick moved through engaging contact with the strings.

There has accordingly been disclosed a pick having novel structure for strumming or otherwise playing a guitar or other stringed musical instrument and which causes the production of new and notably improved sound or tonal characteristics from the pick-string interactions. Contact with the strings may be made on any of a number of surfaces provided on the pick, including single and double edges and corners thereof. The inventive pick is extremely simple and inexpensive to fabricate and advantageously lends itself to the inclusion of selectively positioned member stiffening means to enable the user to obtain a wide ranging variation in the tonal qualities and characteristics of the sounds resulting from contact of the pick with the musical instrument strings.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A pick for use with stringed musical instruments comprising:

a unitary body being a substantially planar member having at least a pair of oppositely disposed edges, a resilient fold provided in said member creasing the same intermediate said oppositely disposed edges to delineate a pair of relatively spaced pick blades of said unitary body connected at and depending from said resilient fold, each of said pick blades carrying one of said oppositely disposed edges and angularly diverging from said fold relative to the other of said pick blades such that when the folded body is grasped in the area of said fold the pick blades may be varied in relative spacing and said edges are disposed in their normally spaced apart relation for multiple sequential sound-generating contact of said edges with a musical instrument string each time said pick is moved across the string.

2. A pick according to claim 1, further comprising:

means on at least a selected portion of said member for predeterminately modifying the tonal characteristics of the sound generated as said pick is moved across a musical instrument string.

3. A pick according to claim 2, said tonal modifying means encompassing at least a portion of one of said edges.

4. A pick according to claim 1, said member being formed of a flexible and resilient material to enable selective variation of the normal spacing between said edges by the application of a selectively applied, oppositely directed force on each of said respective pick blades in the area of said fold as the folded body is grasped so as to permit the predetermined variation of the time interval between said sequential sound-generating contacts of the respective edges with a musical instrument string as said pick is moved across the string and to enable said edges to return to said normally spaced apart relation when said selectively applied oppositely directed force on each of said respective pick blades is removed.

5. A pick according to claim 1, said unitary body being formed initially flat, and said fold normally urging said blades toward the initial flat form while causing the same to assume an angular relationship that is less than said initial flat form of said body such that when an inward force is applied to said blades the same move angularly closer to each other at and in opposition to the normal urging of said fold to return the same toward said initially flat form.

6. A pick for playing a stringed musical instrument comprising:

a pair of pick blades, each of said pick blades having oppositely disposed first and second edges, and fold means on said pick formed unitary with said blades and integrally joining said pick blades to one another at and along said first edges to complete a unitary pick in the shape of a V such that said pick blades angularly diverge outwardly from said joining means and terminate at said second edges so as to normally position said second edges in spaced apart relation for sequential sound-generating contact with a musical instrument string as said unitary pick is moved across the string, said fold means being a resilient connection between said blades enabling the blades to be varied in relative spacing during the use of said pick;

said blades being formed of a flexible and resilient material so that the flexibility and resilience of said pick blades produce a distinctive click as an inseparable part of the sound generated as each of said second edges is moved across the string and substantially brightening the tonal characteristics of the generated sound.

7. A pick according to claim 6, the first and second edges of each of said pick blades being disposed substantially parallel to each other.

8. A pick according to claim 6, the first edge of at least one of said pick blades being disposed non-parallel to the second edge thereof.

9. A pick according to claim 6, at least one of said pick blades carrying stiffening means on at least a selected portion thereof for dulling the tonal characteristics of the sound generated as said second edges are moved across a musical instrument string.

10. A method of forming a pick for use with a stringed musical instrument, comprising the steps of:

fabricating a substantially flat planar unitary body having a pair of oppositely disposed edges, and folding the body intermediate the oppositely disposed edges to crease the body and delineate a pair of pick blades unitarily connected by the fold and carrying the oppositely disposed edges such that each of the pick blades angularly diverges from the fold relative to the other of the pick blades and extends outwardly from the fold to a respective one of the oppositely disposed edges arranged in spaced apart relation to each other so as to form a pick grippable in the area of the fold and movable across a musical instrument string for multiple sequential sound-generating contact of the spaced apart edges with the string each time the pick is moved thereacross.

11. A method of forming a pick according to claim 10, including the additional step of:

applying tone modifying means to at least a selected portion of the body for predeterminately modifying the tonal characteristics of the sound generated thereat as a result of contact of the spaced apart edges of the pick with a musical instrument string.

12. A method of forming a pick according to claim 11, said step of applying tone modifying means including overlaying the tone modifying means on and encompassingly about at least one of the spaced apart edges such that said means directly contacts a musical instrument string as the pick is moved across the string.

* * * * *